United States Patent [19]

Wegener

[11] 4,282,300

[45] Aug. 4, 1981

[54] METHOD FOR DIAZO COPYING OF BLUE LINE ORIGINALS

[75] Inventor: Howard W. Wegener, Amherst, N.H.

[73] Assignee: Eliott Industries, Nashua, N.H.

[21] Appl. No.: 966,347

[22] Filed: Dec. 4, 1978

[51] Int. Cl.[3] ..... G03C 5/02; G03C 5/18

[52] U.S. Cl. ..... 430/146; 430/141; 430/148; 430/150

[58] Field of Search ..... 96/49; 430/148, 150, 430/146, 141

[56] References Cited

U.S. PATENT DOCUMENTS

| | | | |
|---|---|---|---|
| 3,260,599 | 7/1966 | Lokken | 96/75 |
| 3,408,192 | 10/1968 | Acbi | 430/152 |
| 3,536,490 | 10/1970 | Hochberg | 96/49 |
| 3,964,911 | 6/1976 | Robillard | 96/49 |

OTHER PUBLICATIONS

Kosar, Light Sensitive Systems: (1965, by John Wiley & Sons, Inc., pp. 196–201).

Dinaburg, M. S., "Photosensitive Diazo Cpds", The Focal Press, 1964, pp. 145–147.

Kosar, J., "Light-Sensitive Systems", J. Wiley & Sons, 1965, pp. 302–303.

*Primary Examiner*—Charles L. Bowers, Jr.

*Attorney, Agent, or Firm*—Weingarten, Maxham & Schurgin

[57] ABSTRACT

A method and apparatus for producing a highly readable diazo copy from a blue line original. An illumination source provides actinic energy which is substantially absorbed by the blue image of a diazo blue line print and in which no substantial exposure of the diazo paper can occur from energy which is non-responsive to the blue image. The light source produces major energy in the range of about 4600 to 5900 Angstroms. A filter or other means is provided to remove any spurious wavelengths which are non-responsive to the blue image and which can expose the diazo paper.

5 Claims, 7 Drawing Figures

METHOD FOR DIAZO COPYING OF BLUE LINE ORIGINALS

FIELD OF THE INVENTION

This invention relates to diazo reproduction and more particularly to a method and apparatus for diazo copying of originals or masters having a blue image such as blue line and blueprint drawings.

BACKGROUND OF THE INVENTION

The diazo process is well known for reproduction of engineering and technical drawings in which the image appears as blue lines on a white background. These drawings are often called "blue lines" and are the reverse in appearance from the older type of blueprint in which the image is in the form of white lines on a blue background. According to the usual diazo process, a master or original is exposed to ultraviolet light from a suitable source, the light being transmitted through the original onto the sensitized surface of a diazo copy paper. The opaque or darker portions of the original which constitute the image to be copied, do not transmit the light or transmit less of the light than the paper itself, to expose a pattern on the diazo paper corresponding to the original image. The paper is developed by well known dry processes by exposure to ammonia to render the image visible. Diazo copying is very widely employed since no dark room or wet procesing facilities are required.

The original from which diazo copies are made is usually a thin tracing paper or vellum on which the image is drawn or otherwise provided in black pencil or ink to provide a high contrast image from which prints can be made. The blue line print or copy can not itself be employed as an original from which to make a diazo copy, since such a copy will be unreadable or only marginally readable. The blue lines of a diazo copy are transmissive to the light from the illumination source and thus the image is not "seen" by the light. As a consequence, the light from the source passes through the blue image and exposes the diazo paper without delineating the image. Some absorption of light by the blue image can occur, but not sufficiently to yield a developed copy of practical readability.

The problem of making a diazo copy from a blue line original is also present in copying apparatus using reflected rather than transmitted light. In this instance, light from an illumination source striking the surface of a blue line original is reflected off the surface with little or no absorption by the blue image, such that the diazo copy paper is exposed without appearance of the image in any readily readable fashion.

Referring to FIG. 1, there is shown a plot of the spectral energy distribution of a typical diazo copier fluorescent lamp and of the spectral sensitivity of a typical diazo paper. The paper has its major sensitivity in the range of about 3400–4500 Angstroms, with a peak at about 4000 Angstroms. The lamp has its major energy distributed about a peak of about 4200 Angstroms, with secondary peaks at about 5500 and 5800 Angstroms. The blue image of a diazo print has an absorption range of about 4600–5900 Angstroms. The light from a conventional diazo illumination source is not to an appreciable extent responsive to the blue image of a diazo print and is transmitted through the image as if it were not present. In FIG. 1 it is seen that the major energy band of the lamp extends only slightly into the blue line absorption region and is at a relatively low energy level. The major energy of the lamp passes through the blue image and exposes the diazo paper without responding to the image. The lamp energy which is absorbed by the blue image is not effective to expose this image on the diazo paper, since the major exposure of the diazo paper occurs by the energy which has passed through the blue image; thus, no readable copy results.

It would be extremely beneficial to have the capability of making diazo copies from blue line prints without resort to the original. The original is not often available at an office or facility where a copy is desired, while the blue line copies are found almost universally in architectural and engineering offices, machine shops and other technical facilities. These ubiquitous blue line drawings are often in need to be copied without availability of or access to the original.

SUMMARY OF THE INVENTION

In brief, the present invention provides a method and apparatus for producing a highly readable diazo copy from a blue line original. An illumination source is provided having a spectrum which is absorbed by the blue image of the original, and prior to exposure of the diazo paper, any wavelengths of light which are transmissive through the blue image and capable of exposing the diazo paper are removed. Ideally, the lamp itself should produce only the selected spectrum which is absorbed by the blue image and is actinic to the diazo paper. In practice, spurious wavelengths will usually be emitted by the lamp and can be removed by optical filtering prior to exposure of the paper. Alternatively, the diazo paper itself can be made non-responsive to the spurious wavelengths of light, either by adjustment of the spectral sensitivity, or by use of an absorbing or reflective coating on the paper.

Preferably, the diazo paper employed in the invention has a spectral sensitivity which substantially overlaps the spectral emission of the light source. Standard diazo papers can be used to produce readable diazo copies in the form of azo dye images by use of the invention, although exposure time can be reduced by papers having improved sensitivity in the spectral regions specified by the invention. After exposure of the paper, development of the azo dye image can be accomplished by any known development process such as the widely used dry ammonia process.

DESCRIPTION OF THE DRAWINGS

The invention will be more fully understood from the following detailed description, taken in conjunction with the accompanying drawings, in which.

DETAILED DESCRIPTION OF THE INVENTION

Figure 1:
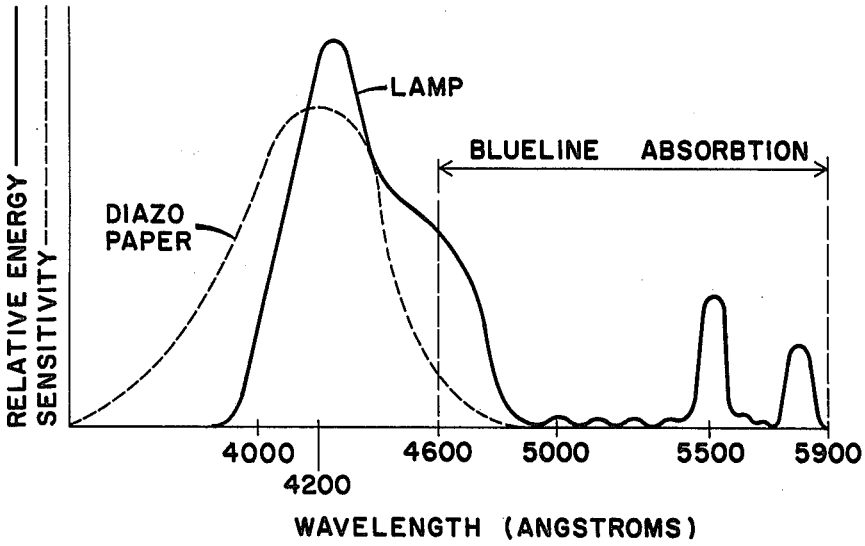
FIG. 1 is a plot of the spectral characteristics of a typical conventional diazo copy lamp and of a typical known diazo paper.
Figure 2:
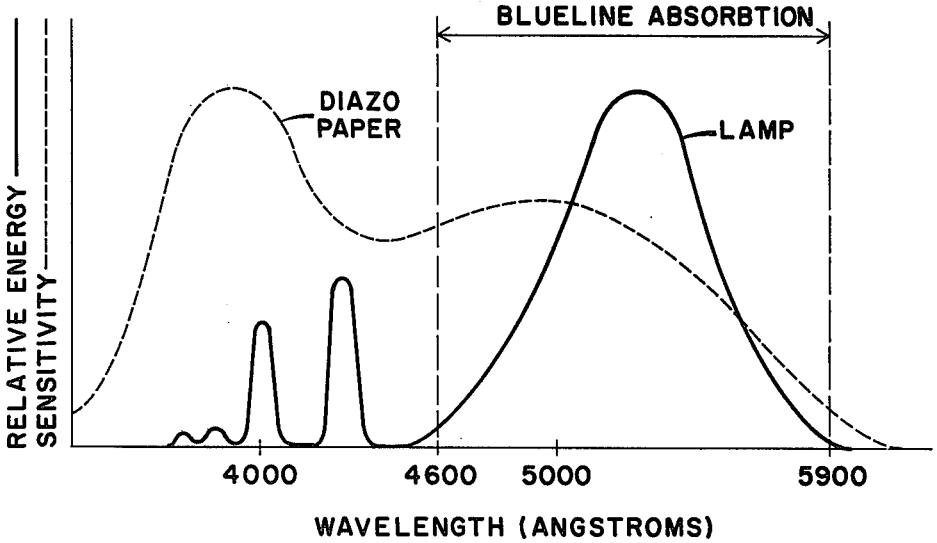
FIG. 2 is a plot of the spectral characteristics of a diazo copy lamp and diazo paper in accordance with the invention.

In accordance with the novel diazo process and apparatus, a source of illumination provides actinic energy which is substantially absorbed by the blue image of a diazo blue line print, and in which no substantial exposure of the diazo paper can occur from energy which is non-responsive to the blue image. Referring to FIG. 2, there is shown a plot of the spectral emission of a light source and the spectral sensitivity of a diazo paper provided according to the invention. The light source, preferably a fluorescent lamp, produces major energy in the range of about 4600–5900 Angstroms, with secondary peaks at shorter wavelengths. The major energy is in the blue line absorption band of the blue image of a blue line diazo copy. The diazo paper has a spectral sensitivity which is broader than the spectrum of the light source, and which overlaps the light source spectrum. There should be sufficient overlapping of the light and paper spectra to yield sufficient sensitivity for production of a diazo copy in a reasonably short exposure time. It is evident that the light source has spurious energy at wavelengths which are not absorptive to the blue image and which are actinic to the diazo paper. Such spurious energy must be removed or substantially reduced in magnitude to permit achievement of readable diazo copies of a blue line original.

The relative spectral characteristics of the light source and the diazo paper can be achieved in several different ways. In ideal implemention, the light source provides an emission spectrum only in the region which is absorbed by the blue image of the print to be copied and which is actinic to the diazo paper. However, the light source usually has spurious wavelenths in addition to the intended spectral emission, as seen in FIG. 2. These spurious wavelengths can pass through the blue image of the print and expose the diazo paper and thus obliterate or substantially diminish the readability of the diazo copy. In a fluorescent lamp, spurious emissions occur at 4070 and 4357 Angstroms due to mercury in the lamp. These wavelengths, which are in the visible violet region, pass through the blue image with substantially no absorption. To remove these spurious wavelengths, a filter is employed to prevent exposure of the diazo paper by light which has passed through the blue image. The filter may not be needed in instances where the sensitivity of the diazo paper at intended wavelengths is sufficiently greater than the sensitivity at spurious wavelengths.

Figure 3:
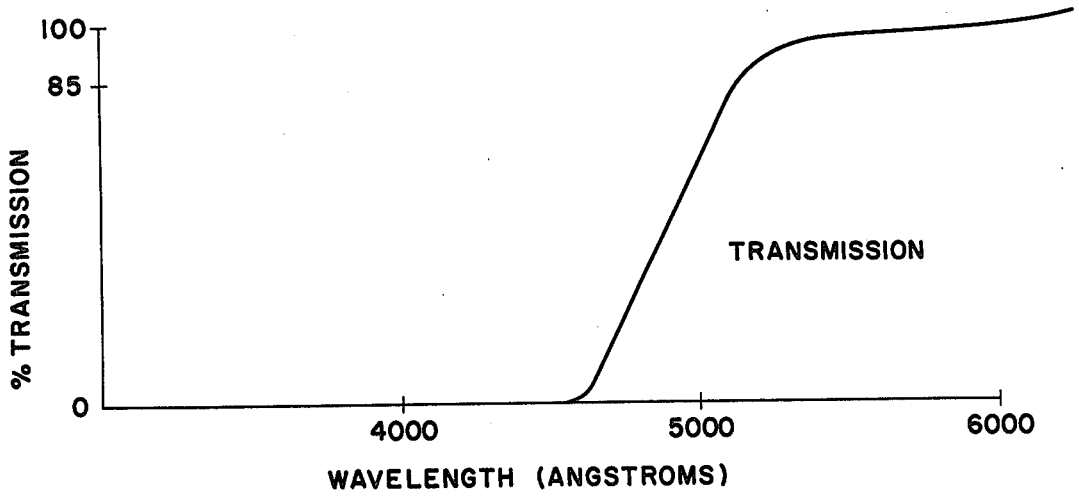
FIG. 3 is a plot of the filter response of an optical filter useful in practice of the invention.

The filter to remove spurious spectral components has a typical response characteristic as shown in FIG. 3, and is a high pass optical filter having a cutoff at about 4800 Angstroms. This filter is, for example, a Martin processing type 1059. Thus, no significant energy is transmitted by the filter which could pass through the blue image and expose the diazo paper. The filter can be implemented by known dye or interference filter techniques. The illustrated response curve of FIG. 3 is for a yellow dye filter coated on a 2 mil polyester film base.

In alternative implementation of the invention, the diazo paper can itself have a coating which absorbs or reflects the unwanted wavelengths to prevent exposure of the sensitized surface by these spurious wavelengths. As a further alternative the diazo paper can be formulated to provide a spectral sensitivity only to the spectrum of light which is absorbed by the blue image and thus provide a paper which is not sensitive to the spurious wavelengths. Such a diazo formulation usually includes a photosensitive composition sensitive to the intended spectrum and with inhibitors to minimize sensitivity to the spurious spectral components.

Figure 4:
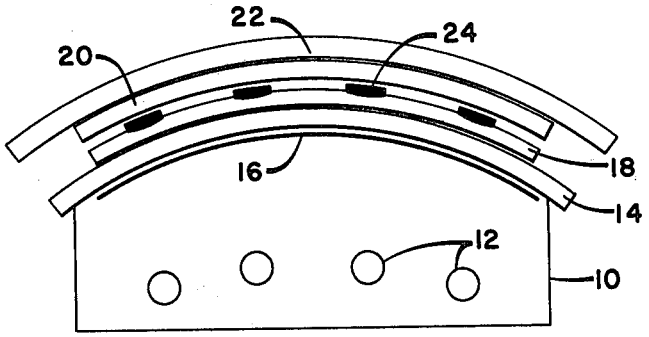
FIG. 4 is a diagrammatic view of diazo copying apparatus in accordance with the invention.

Diazo copying apparatus embodying the invention is shown in FIG. 4 and comprises a housing 10 containing one or more lamps 12 providing a predetermined spectral emission as described above. A glass plate 14 is provided on the housing 10 and on which is disposed a filter sheet 16 operative to remove the spurious light wavelengths. A blue line original 18 to be copies is disposed on the glass plate 14 and in contact with the sensitized surface of an overlying diazo paper 20. A cover sheet 22 can be provided for retaining the diazo paper and the blue line original in intimate contact on the glass plate. In this embodiment, the image 24 on the surface of original 18 is in contact with the sensitized surface of the diazo paper to provide a copy of high definition. The copied image provided on the diazo paper will of course be reversed, and the copying process will have to be repeated to yield a rectified image. To provide a right reading print, without image reversal, the original 18 can be disposed in the copying apparatus with its image 24 on the surface opposite to the surface of original 18 in contact with the sensitized surface of the diazo paper. Although some diffusion of the image occurs by reason of the thickness of the sheet through which the light must pass before exposure of the diazo paper, any resulting distortion of the exposed image is slight and does not materially affect the readibility of the copy.

Figure 5:
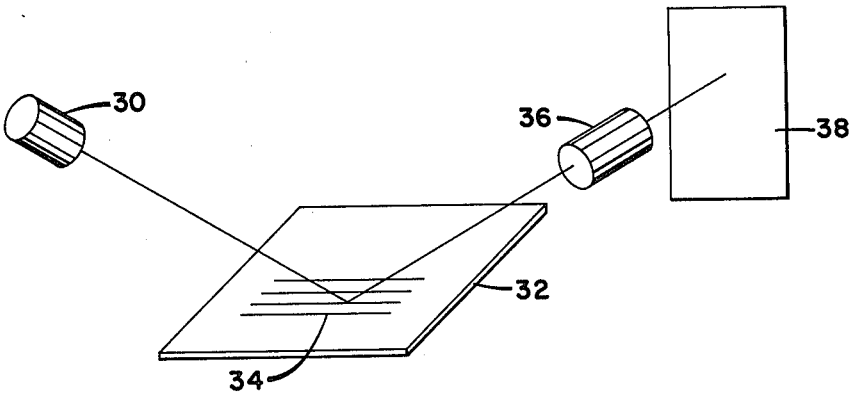
FIG. 5 is a diagrammatic representation of reflective type diazo copying apparatus which can also be employed in practice of the invention.

The invention can also be employed with a reflective type of copier apparatus as schematically depicted in FIG. 5. Here a light source 30 illuminates the surface of an original 32 on which a blue image 34 is present. Light reflected from the image-containing surface of original 32 is focused by optical assembly 36 onto the sensitized surface of a diazo paper 38 for exposure thereof. The light source 30 provides a spectrum which is absorbed by the blue image, and any unwanted wavelengths which are reflective to the blue image and which can expose the diazo paper are removed by one of the filtering techniques described above such that the diazo paper 38 is exposed only by light which is absorbed by the blue image. A readably copy of the blue image is thereby produced upon development of the exposed sheet 38.

The light source is preferably a fluorescent lamp having a spectral emission in the intended range to be absorbed by the blue image of the original and actinic to the diazo paper. Other sources of illumination can be employed to provide the desired spectral emission in the range of about 4600–5900 Angstroms. It is noted that the glass plate of the copying apparatus may itself serve as a filter for removal of unwanted light components. Glass usually filters the shorter ultraviolet light wavelengths but does not usually filter the longer wavelengths of the ultraviolet and visible violet spectrum. Thus, an additional filter sheet or coating is usually required to remove all of the spurious light components.

Figure 6:
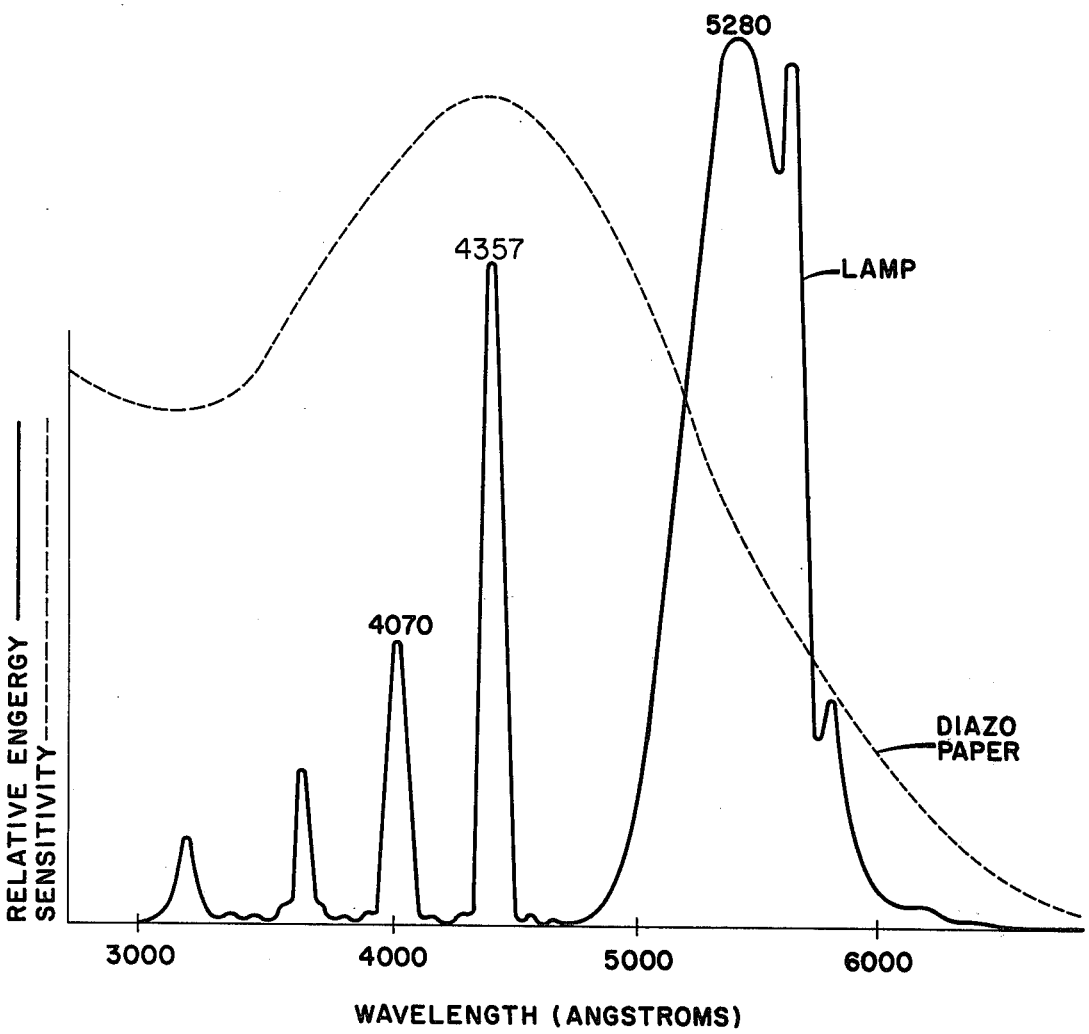
FIG. 6 is a plot of the spectral energy distribution of a fluorescent lamp and of the spectral sensitivity of a diazo paper in accordance with the invention.

Referring to FIG. 6, there is shown a particular example of the spectral energy distribution of a fluorescent lamp and spectral sensitivity of a diazo paper in accordance with the invention. The lamp, for example, is a Sylvania F40G fluorescent lamp. This lamp produces major energy in the range of about 5000–5750 Angstroms. Spurious emissions occur as illustrated in ultraviolet and visible portions of the spectrum. The diazo paper has a very broad spectral sensitivity which peaks at about the unwanted wavelength of 4358 produced by the presence of mercury in the fluorescent lamp. The paper has reasonable sensitivity in the spectral range which overlaps that of the lamp. Typical commercially available high speed diazo copy papers are Azon Cat. No. 2521, Addressograph-Multigraph 29-2080, and Rotolite Cat. No. 216M. A filter having a response as shown in FIG. 3 is interposed between the lamp and the diazo paper to remove these components of light which are outside of the absorption band of the blue image of the diazo original, which otherwise would expose the diazo paper and prevent formation of a readable image. The diazo paper providing the sensitivity characteristics illustrated in FIG. 6 is a standard type. A diazo paper formulated to have greater sensitivity to the uniquely tuned light source will allow a shorter exposure time to achieve a readable image. The formulation of particular diazo compositions having the desired spectral sensitivity is within the ordinary skill of the art and is not part of this invention.

Figure 7:
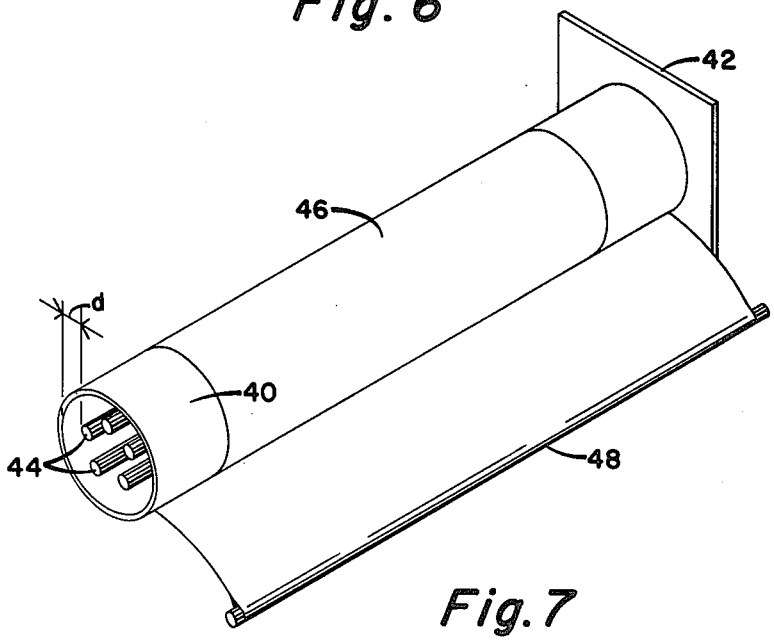
FIG. 7 is a pictorial view of a diazo copying machine in accordance with the invention.

In actual implementation of apparatus for practice of the invention, conventional diazo copying machines can be employed to provide support of an original and a copy sheet for exposure. Typical apparatus is shown in FIG. 7. A glass dylinder 40 is rotatably supported by a suitable frame 42 and is of a length and circumference to accommodate sheets of predetermined maximum size to be copied. An array of five fluorescent lamps 44 is disposed within the glass cylinder 40 symmetrically spaced about the circumference of the cylinder. The lamps 44 are supported on brackets provided on frame 42, the brackets including electrical connectors by which energizing electrical power can be applied to the lamps. The lamps are each 48 inches in length, in one typical size, operated in a very high output (vho) mode and having an output rating of about 11,500 lumens. The shortest radial distance d from the fluorescent lamps to the inner surface of the cylinder 40 is about $1\frac{7}{8}$ inches in the illustrated embodiment. A filter sheet 46 is disposed around cylinder 40 and covers the entire operative area of the cylinder. To provide a diazo copy, a blue line original is placed over the filter sheet 46 and a diazo copy paper is placed over the original. The cylinder 40 is rotated, typically by spring action, to roll up the curtain 48 which serves to maintain the original and copy sheets in intimate contact on the outer surface of the cylinder.

The lamps are then energized to provide exposure of the copy paper, and after a predetermined exposure time has elapsed, the lamps are de-energized and the copy sheet is removed for development by any convenient process, usually a dry ammonia process. The apparatus can operate over the usual temperature range within which the diazo paper remains stable, usually about 100°–130° F.

Various modifications and alternative implementations can be made in practice of the invention without departing from the spirit and true scope thereof. It will be appreciated that reference to diazo paper is not limited to paper as such but more broadly comprehends any sheet material on which a photosensitive diazo coating is provided, such as transparent base stock. Accordingly, the invention is not to be limited by what has been particularly shown and described except as indicated in the appended claims.

What is claimed is:

1. A diazo process for copying a blue line original having blue line image areas having light absorption range of about 4600–5900 Angstroms comprising the steps of:

placing the blue line original and a diazo copy sheet in light exposing relationship for imaging of the blue line image areas of the original onto the photosensitive surface of the diazo copy sheet;

providing a light source having an emission spectrum which is absorbed by the blue line image areas of the original and which is actinic to the photosensitive surface of the copy sheet;

exposing the photosensitive surface of the copy sheet to image-wise exposure by said emission spectrum;

removing from the emission spectrum prior to exposure of the photosensitive surface of the copy sheet any wavelengths of light which are transmissive through said blue line image areas of the original and which are capable of exposing the copy sheet by filtering the emission spectrum of the light source to pass only the portion of the emission spectrum within said light absorption band of the blue line image areas of the original; and developing the copy sheet to provide a visible azo dye rendition of the original blue line image.

2. The process of claim 1 wherein the filtering step includes filtering the portion of the emission spectrum having wavelengths less than about 4800 Angstroms, thereby to remove any wavelengths which are not absorbed by the blue line image of the original and capable of exposing the copy sheet.

3. The process of claim 1 wherein the removing step includes:

providing on the diazo copy sheet a coating which absorbs or reflects the said wavelengths.

4. The process of claim 1 wherein said light source is a diazo copier fluorescent lamp with a major energy emission peak at about 4200 Angstroms with secondary peaks at about 5500 and 5800 angstrom.

5. The process of claim 1 wherein said emission spectrum removal step is performed by using a high pass optical filter.

* * * * *